United States Patent [19]

Roe et al.

[11] Patent Number: 4,658,461

[45] Date of Patent: Apr. 21, 1987

[54] FLAT PAD APPLICATOR

[75] Inventors: Elverton O. Roe; Charles G. Moore, both of Wooster, Ohio

[73] Assignee: The Wooster Brush Company, Wooster, Ohio

[21] Appl. No.: 783,140

[22] Filed: Oct. 2, 1985

[51] Int. Cl.[4] ..... B05C 1/06

[52] U.S. Cl. ..... 15/210 R; 15/144 R; 15/145; 15/176; 15/244 A

[58] Field of Search ..... 15/144 R, 145, 159 R, 15/172, 176, 209 R, 209 B, 210 R, 220 R, 220 A, 210.5, 244 R, 244 A, 244 B; 51/362, 393; 16/110 R

[56] References Cited

U.S. PATENT DOCUMENTS

| | | | |
|---|---|---|---|
| 3,162,876 | 12/1964 | Aronson, II et al. | 15/176 X |
| 3,605,165 | 9/1971 | Burns | 15/210 R |
| 4,455,705 | 6/1984 | Graham | 15/144 R |

FOREIGN PATENT DOCUMENTS

| | | | |
|---|---|---|---|
| 2058374 | 3/1972 | Fed. Rep. of Germany | 15/144 R |

*Primary Examiner*—Edward L. Roberts

*Attorney, Agent, or Firm*—Renner, Otto, Boisselle & Lyon

[57] ABSTRACT

Flat pad applicator includes a base member having a pair of laterally spaced apart tapered pins between which the hub portion of a handle is snapped into position for rotatably mounting the handle on the base member. The hub portion has a plurality of circumferentially spaced indexing notches in the outer periphery thereof which may be selectively engaged by an indexing locking rib carried by a cantilevered tongue on the base member for releasably locking the handle in any one of several angularly adjusted positions. The pad assembly itself includes a backing plate made out of a magnetic material to permit a magnet to be used for easy attachment and removal of the pad assembly from the base member for cleaning and/or replacement.

18 Claims, 5 Drawing Figures

FLAT PAD APPLICATOR

BACKGROUND OF THE INVENTION

This invention relates generally as indicated to a flat pad applicator and more particularly to certain improvements in the manner of attachment of the handle and pad assembly to the applicator base.

In such a flat pad applicator, it is desirable to be able to adjust the angular orientation of the handle with respect to the base member for use in different applications. Also, it is desirable to be able readily to remove the pad assembly from the base member for ease of cleaning and/or replacement after use.

SUMMARY OF THE INVENTION

In accordance with the present invention, the handle has a hub portion which snaps into position between a pair of laterally spaced apart bosses on the applicator base for rotatably mounting the handle on the base.

Also in accordance with the invention, the hub portion has a plurality of circumferentially spaced indexing notches in the outer periphery thereof which are selectively engaged by an indexing latching rib carried by a cantilevered tongue on the base for releasably locking the handle in any one of several angular adjusted positions for ease in using the applicator to coat differently oriented surfaces of varying heights and lengths including walls, ceilings and floors and the like.

In accordance with another aspect of the invention, a magnet assembly is provided in the base for releasably attaching the pad assembly to the base. The pad assembly includes a backing plate made out of a suitable magnetic material which is held against the base by the magnet assembly.

Further in accordance with the invention, the front edge of the backing plate has an inturned lip for hooking engagement onto the front edge of the base, whereas the back edge has an upturned lip to prevent the base from being inadvertently pulled off the back of the pad assembly.

Also in accordance with the invention, the magnet assembly is mounted on the underside of the base for direct contact with the pad backing plate to maximize the magnetic holding power. Preferably, the magnet assembly is located closely adjacent the back edge of the base to maximize the distance between where the pad assembly hooks over the front edge of the base and where the magnet comes into contact with the backing plate for increased retention of the pad assembly on the base. A slight downward pressure on the back edge of the backing plate releases the pad assembly from the magnet for easy pad removal.

Further in accordance with the invention, a notch is desirably provided in the front lip of the backing plate intermediate the ends thereof for receipt of a projection on the front edge of the base to locate the pad on the base and prevent lateral movement.

To the accomplishment of the foregoing and related ends, the invention, then, comprises the features hereinafter fully described and particularly pointed out in the claims, the following description and the annexed drawings setting forth in detail a certain preferred embodiment of the invention, this being indicative, however, of but one of the various ways in which the principles of the invention may be employed.

DETAILED DESCRIPTION OF THE PREFERRED EMBODIMENT

Figure 1:
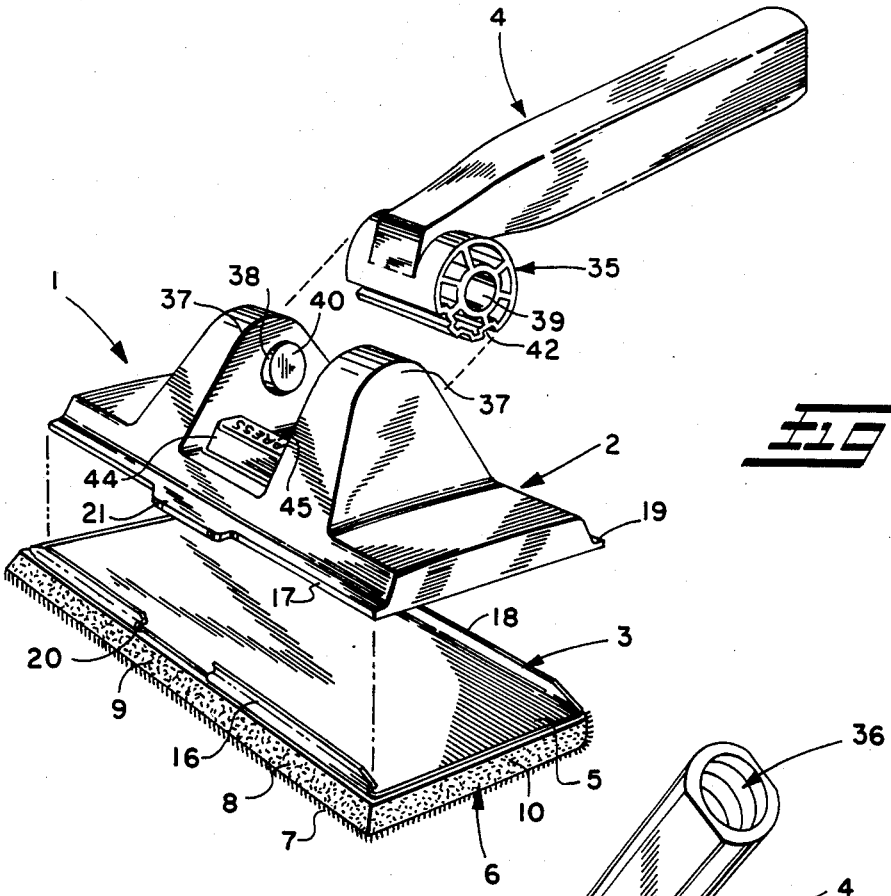
FIG. 1 is an exploded isometric view of a preferred form of flat pad applicator in accordance with this invention as viewed from the front right side.
Figure 2:
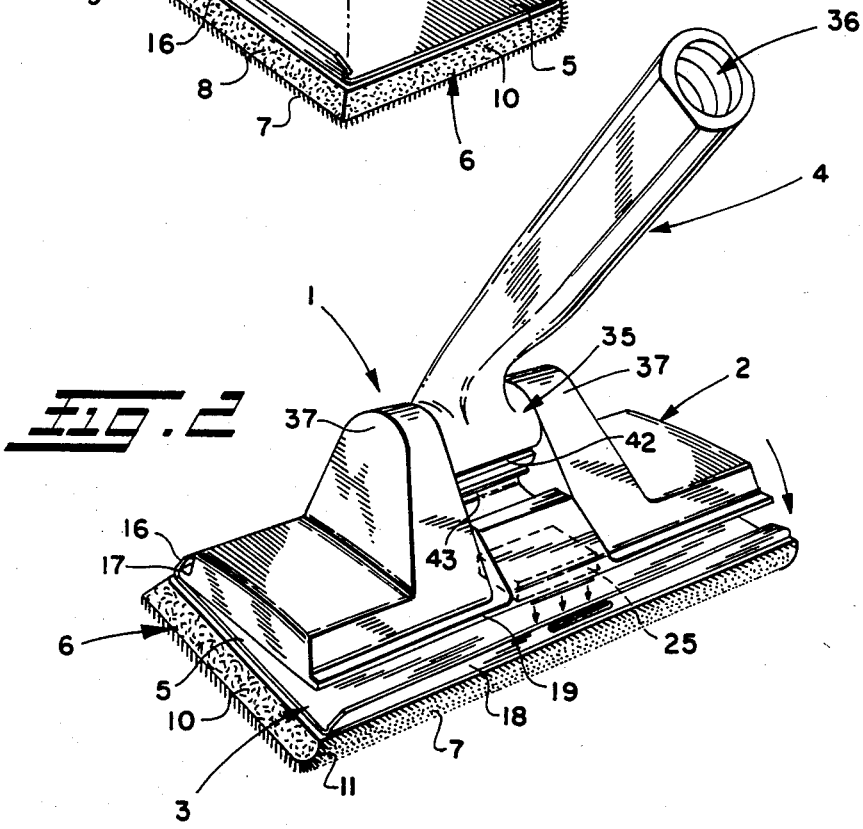
FIG. 2 is an isometric view of the flat pad applicator of FIG. 1 as viewed from the rear left side thereof with the parts assembled but showing how the pad assembly is released from the applicator base.
Figure 4:
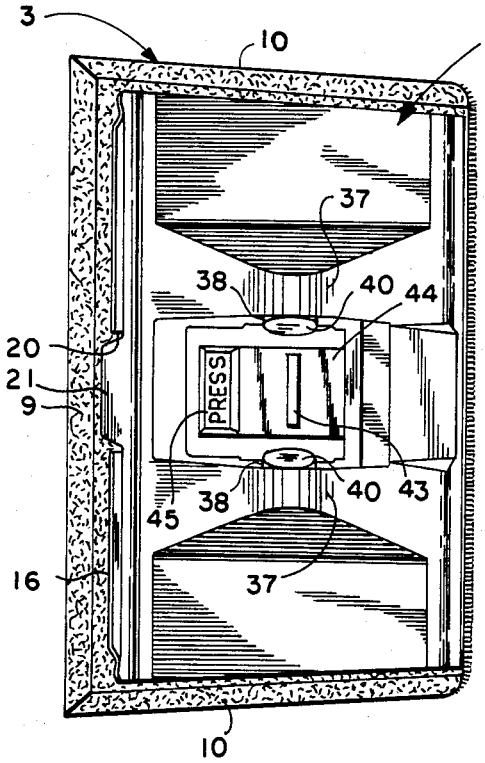
FIG. 4 is a top plan view of the applicator base as seen from the plane of the line 4—4 of FIG. 3 but with the handle removed.
Figure 3:
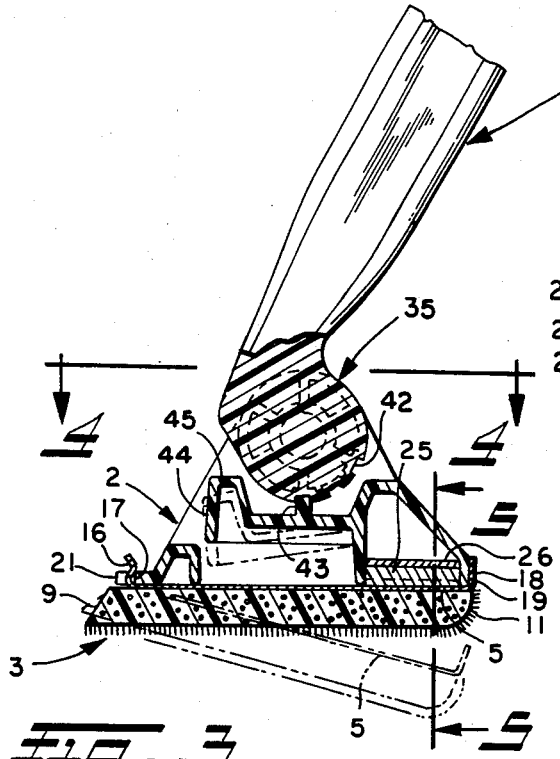
FIG. 3 is a fragmentary longitudinal section through the flat pad applicator of FIGS. 1 and 2.

Referring now in detail to the drawings, there is shown a preferred form of flat pad applicator 1 in accordance with this invention which as best seen in FIG. 1 includes three main sub-assemblies, namely, a base member 2, a pad assembly 3 adapted for removable attachment to the base member, and a pivotally adjustable handle 4. Both the base member 2 and handle 4 are desirably molded out of a suitable plastic material, whereas the pad assembly 3 desirably consists of a metal backing plate 5 having a pad 6 cemented to the bottom side thereof. The pad may be of any suitable type, but desirably consists of an outer layer 7 of suitable fabric such as mohair having a polyurethane or like sponge backing 8 which allows the outer fabric layer to give and flex when pressure is applied. Also, as best seen in FIG. 4, the pad desirably tapers inward from front to back and is desirably provided with beveled front and side edges 9, 10 to make it easier to paint in corners and the like. Moreover, the back edge 11 is desirably rounded, and the fabric layer 7 desirably extends around such back edge as best seen in FIGS. 2 and 3 to permit the back edge to be used to smooth or feather out the coating material as it is being applied by the applicator.

Referring further to the pad assembly, the front edge of the backing plate 5 desirably has an inturned lip 16 thereon for hooking engagement over the front edge 17 of the base member 2, whereas the back edge of the backing plate has an upturned lip 18 which extends above the back edge 19 of the base member when the backing plate is held up against the bottom of the base member to prevent the base member from being inadvertently pulled off the back side of the pad assembly. At the same time, the upturned back lip 18 permits the pad assembly to be pivoted about the front edge of the base member when hooked thereon for swinging movement toward and away from the underside of the base member as shown in FIG. 3. Also, a notch 20 is desirably provided in the front lip 16 of the backing plate 5 for receipt of a projection 21 on the front edge 17 of the base member to locate the pad assembly 3 on the base member and prevent lateral movement thereof relative to the base member during use.

Figure 5:
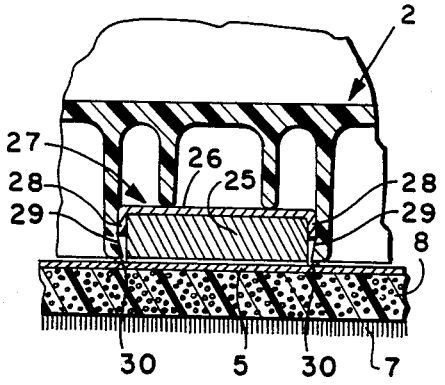
FIG. 5 is an enlarged transverse section through the flat pad applicator of FIG. 3, taken generally along the plane of the line 5—5 thereof.

Preferably, a magnet 25 is used to releasably retain the pad assembly in place against the underside of the base member. As clearly shown in FIGS. 3 and 5, the magnet 25 is cemented within a channel shaped magnet holder 26, and the entire assembly is mounted within a recess 27 on the underside of the base member and retained in place as by engagement of metal tabs 28 on the end walls of the holder with the side walls 29 of the recess. To maximize the holding power of the magnet, the magnet holder 26 is made of a magnetic material such as a ferrous material, and the end walls 30 of the magnet holder extend slightly below the bottom of the magnet and underside of the base member for direct contact with the pad backing plate 5 which is also made of a suitable magnetic material such as tin plate. Furthermore, the magnet assembly is desirably located closely adjacent the back edge of the base member to maximize the distance between where the pad assembly hooks onto the front edge of the base member and where the magnet comes into contact with the backing plate to increase the holding force. A slight downward pressure on the upturned back lip 18 of the backing plate 5 releases the pad assembly from the magnet for easy pad removal as shown in FIGS. 2 and 3.

The handle 4 itself has a hub portion 35 at its inner end and a recess 36 at the outer end (see FIG. 2) which may be internally threaded for connection of a handle extension thereto. The hub portion 35 is pivotally mounted between a pair of laterally spaced bosses 37 on the base member 2. Each boss has a pin 38 extending inwardly therefrom in alignment with each other for extension into a recess or opening 39 in the respective ends of the handle hub portion (see FIG. 1). The outer ends 40 of the pins 38 are desirably tapered toward each other from top to bottom to facilitate snapping engagement of the pins into the recesses in the ends of the handle hub portion when forced into position between the bosses.

When thus assembled, the handle may be pivoted about the pins 38 to vary the angular position of the handle relative to the base member to suit the user of the applicator. To secure the handle in the desired adjusted position, a plurality of circumferentially spaced indexing notches 42 are desirably molded in the outer periphery of the hub portion 35 for selective engagement by an indexing locking rib 43 carried by a cantilevered tongue 44. The tongue is also desirably made of a suitable plastic material, and has one end integrally molded to the back of the base member. As clearly shown in FIG. 3, the tongue is cantilevered forwardly from such one end and extends between the bosses 37 beneath the handle hub portion 35 with its outer free end protruding in front of the hub portion. The indexing locking rib 43, on the other hand, is located intermediate the ends of the tongue directly beneath the handle hub portion 35 and is normally biased into engagement with the exterior surface of the hub portion due to the inherent flexibility of the plastic tongue.

Although the number and spacing of the notches 42 in the handle hub portion may be varied depending on the number and angular orientations of handle positions desired, in the preferred form of flat pad applicator shown, three such notches are provided to allow the handle to be indexed to any one of three positions, namely, a first position in which the handle is substantially horizontal or parallel to the working surface of the pad and second and third positions in which the handle is tilted at an angle of 30° and 60°, respectively, with respect to the horizontal. The handle is shown in the 60° position in FIGS. 2 and 3.

At the outer free end of the plastic tongue 44 is a raised thumb pad 45. To move the handle from one position to another is a simple matter, it only being necessary to press down on the thumb pad 45 to deflect the tongue 44 downwardly as a cantilever spring as shown in phantom lines in FIG. 3, disengaging the indexing locking rib 43 from any one of the notches 42.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A pad applicator for use in applying coatings to surfaces comprising a base member having top and bottom sides, a handle member attached to the top side of said base member, a pad assembly having a backing plate made of magnetic material, said backing plate having an inturned lip on the front edge thereof for hooking engagement over the front edge of said base member, and magnet means located adjacent the back edge of said base member for magnetically attaching said backing plate to the bottom side of said base member adjacent the back edge of said backing plate.

2. The pad applicator of claim 1 wherein said magnet means includes a magnet holder having end walls made of a magnetic material which extend slightly beneath the bottom side of said base member for direct contact with said backing plate.

3. The pad applicator of claim 1 wherein the back edge of said backing plate has an upturned lip which extends above the back edge of said base member when said pad assembly is up against the bottom side of said base member to prevent said base member from being inadvertently pulled off the back of said pad assembly while at the same time permitting said pad assembly to be pivoted about the front edge of said base member for swinging movement toward and away from said base member.

4. The pad applicator of claim 1 wherein said inturned lip on the front edge of said backing plate has a notch therein for receipt of a projection on the front edge of said base member to locate said pad assembly on said base member and prevent lateral movement of said pad assembly relative to said base member during use of said pad applicator.

5. A pad applicator for applying coatings to surfaces comprising a base member having top and bottom sides, a pad assembly mounted on the bottom side of said base member, a handle member pivotally attached to the top side of said base member, said handle member including a handle hub portion having a plurality of circumferentially spaced indexing notches in the outer periphery thereof, and said base member having a cantilevered spring-like tongue projecting therefrom, said tongue having an indexing locking rib thereon engageable in any one of said indexing notches on said handle hub portion for releasably locking said handle member in any one of several different angular positions, said tongue being made of a spring-like material which normally biases said indexing locking rib towards said handle hub portion, said tongue being made of a plastic material which may be deflected away from said handle hub portion for disengaging said indexing locking rib from any one of said indexing notches, one end of said tongue being integrally molded to said base member which is also made out of a plastic material, and the other end of said tongue being free to be pushed away from said handle hub portion to disengage said indexing locking rib from any one of said indexing notches.

6. The pad applicator of claim 5 wherein said one end of said tongue is connected to said base member adjacent the back side thereof, and the other end of said tongue extends forwardly of said handle hub portion and has a thumb pad thereon for pressing engagement by an operator to disengage said indexing locking rib from any one of said indexing notches.

7. The pad applicator of claim 6 wherein said indexing locking rib is located intermediate the ends of said tongue directly beneath said handle hub portion.

8. A pad applicator for applying coatings to surfaces comprising a base member having top and bottom sides, a pad assembly mounted on the bottom side of said base member, a handle member pivotally attached to the top side of said base member, said handle member including a handle hub portion having a plurality of circumferentially spaced indexing notches in the outer periphery thereof, and said base member having a cantilevered spring-like tongue projecting therefrom, said tongue having an indexing locking rib thereon engageable in any one of said indexing notches on said handle hub portion for releasably locking said handle member in any one of several different angular positions, and magnet means for releasably connecting said pad assembly to said base member, said pad assembly including a backing plate made of a magnetic material, and said magnet means being mounted adjacent the bottom side of said base member for magnetically holding said backing plate up against said bottom side, said backing plate having an inturned lip on the front edge thereof for hooking engagement over the front edge of said base member, and said magnet means being located adjacent the back edge of said base member for magnetically engaging said backing plate adjacent the back edge of said backing plate.

9. The pad applicator of claim 8 wherein the back edge of said backing plate has an upturned lip which extends above the back edge of said base member when said pad assembly is up against the bottom side of said base member to prevent said base member from being inadvertently pulled off the back of said pad assembly while at the same time permitting said pad assembly to be pivoted about the front edge of said base member for swinging movement toward and away from said base member.

10. The pad applicator of claim 8 wherein said inturned lip on the front edge of said backing plate has a notch therein for receipt of a projection on the front edge of said base member to locate said pad assembly on said base member and prevent lateral movement of said pad assembly relative to said base member during use of said pad applicator.

11. A pad applicator for applying coatings to surfaces comprising a base member having top and bottom sides, a pad assembly mounted on the bottom side of said base member, a handle member pivotally attached to the top side of said base member, said handle member including a handle hub portion having a plurality of circumferentially spaced indexing notches in the outer periphery thereof, and said base member having a tongue with an indexing locking rib thereon engageable in any one of said indexing notches on said handle hub portion for releasably locking said handle member in any one of several different angular positions, said tongue being made of a spring-like plastic material which normally biases said indexing locking rib towards said handle hub portion, said tongue having one end integrally molded to said base member which is also made out of a plastic material, and another end which is free to be pushed away from said handle hub portion to disengage said indexing locking rib from any one of said indexing notches.

12. The pad applicator of claim 11 wherein the top side of said base member has a pair of laterally spaced apart bosses between which said handle hub portion is pivotally mounted.

13. The pad applicator of claim 12 wherein said handle hub portion has recesses in opposite ends thereof, and said bosses have pins projecting toward each other which extend into said recesses.

14. The pad applicator of claim 13 wherein the outer ends of said pins are tapered toward each other from top to bottom to facilitate snapping engagement of said pins into said recesses in the ends of said handle hub portion when forced into position between said bosses.

15. The pad applicator of claim 11 further comprising magnet means for releasably connecting said pad assembly to said base member.

16. The pad applicator of claim 15 wherein said pad assembly includes a backing plate made of a magnetic material, and said magnet means is mounted adjacent the bottom side of said base member for magnetically holding said backing plate up against said bottom side.

17. The pad applicator of claim 16 wherein said magnet means includes a magnet holder having end walls made of a magnetic material which extend slightly beneath the bottom side of said base member for direct contact with said backing plate.

18. A pad applicator for use in applying coatings to surfaces comprising a base member having top and bottom sides, a handle member attached to the top side of said base member, a pad assembly having a backing plate made of magnetic material, said backing plate having means on the front edge thereof for hooking engagement over the front edge of said base member, and magnet means located adjacent the back edge of said base member for magnetically attaching said backing plate to the bottom side of said base member adjacent the back edge of said backing plate.

* * * * *